US005397096A

United States Patent [19]

Nelson

[11] Patent Number: 5,397,096

[45] Date of Patent: Mar. 14, 1995

[54] FORMING APPARATUS FOR CONCRETE FLOORS, CEILINGS AND WALLS

[76] Inventor: Stevan T. Nelson, 4429 Manchester La. NW., Rochester, Minn. 55901

[21] Appl. No.: 12,042

[22] Filed: Feb. 1, 1993

[51] Int. Cl.[6] ..... E04G 11/40

[52] U.S. Cl. ..... 249/31; 249/28; 249/176; 249/177; 249/188

[58] Field of Search ..... 249/28, 29, 30, 31, 249/32, 134, 176, 177, 188

[56] References Cited

U.S. PATENT DOCUMENTS

| | | | |
|---|---|---|---|
| 1,079,045 | 11/1913 | Hammett | 249/176 X |
| 1,278,087 | 9/1918 | Ambursen | 249/29 |
| 1,292,986 | 2/1919 | Ambursen | 249/30 |
| 1,846,195 | 2/1932 | Goldsmith | 249/29 |
| 1,846,196 | 2/1932 | Goldsmith | 249/31 |
| 1,887,385 | 11/1932 | Wertz | 249/30 |
| 1,891,557 | 12/1932 | Roos | 249/31 |
| 2,206,939 | 7/1940 | Carilli | 25/131 |
| 3,314,638 | 4/1967 | Morrison | 249/31 X |
| 3,543,458 | 12/1970 | Guritz | 249/28 |
| 3,592,437 | 7/1971 | Dashew | 249/175 |
| 3,807,681 | 4/1974 | Kane et al. | 249/29 |
| 3,912,217 | 10/1975 | Norlander | 249/31 |
| 4,003,542 | 1/1977 | Beer et al. | 249/31 |
| 4,023,765 | 5/1977 | Kinnamon | 249/29 |
| 4,170,338 | 10/1979 | Nilsson | 249/31 |
| 4,243,200 | 1/1981 | Beer et al. | 249/187 R |
| 4,659,057 | 4/1987 | Felter | 249/97 |
| 5,200,210 | 4/1993 | Schimpff | 425/577 |

*Primary Examiner*—James C. Housel
*Assistant Examiner*—Harold Y. Pyon
*Attorney, Agent, or Firm*—Palmatier, Sjoquist & Helget

[57] ABSTRACT

A reusable low maintenance forming system for forming concrete floors, ceilings and walls with joists thereunder utilizes concrete displacement form pans supported by a temporary framework and floor. A plurality of alignment channels are arranged in parallel series of elongate aligned rows and are adapted to alignably receive and support the flanges of parallel and adjacent form pans. A plurality of joist bottomed wedges are arranged in parallel series of aligned rows and adapted to fit within the alignment channels as to abut and seal against the lower free ends of the form pans afterwhich uncured concrete may be placed over the system.

18 Claims, 5 Drawing Sheets

FORMING APPARATUS FOR CONCRETE FLOORS, CEILINGS AND WALLS

BACKGROUND OF THE INVENTION

This invention generally relates to concrete floors and ceilings typified by having parallel ribs, beams or joists integrally formed thereunder. More particularly, this invention relates to a new and improved forming system for creating concrete floors and ceilings as described.

Various types of support framework and form pan structures are known for supporting and shaping various types of concrete slab structures such as flooring and ceiling or roof decks. Several such form pan structures and support frameworks are disclosed in the following U.S. Pat. Nos.: 2,206,939; 3,807,681; 4,003,542; 4,170,338; 4,243,200; and 4,659,057.

The problems with these known pan form systems are multiple. Extensive time is needed in setting the forms up on the false framework or temporary decking. The pan forms are extremely difficult in removing from the cured concrete requiring extensive chiseling and prying which results in a blemished underside appearance of the ceiling or flooring. Also, the abuse that the form pans are subjected to in their removal from the cured concrete required extensive maintenance to maintain the trueness of the flanges of the pans.

There is a need for a forming system for concrete floors and ceilings that will work efficiently, economically, rapidly, will form attractive and high quality concrete floor and roof deck constructions, will require minimal maintenance to the form pans, and will readily adapt to be used with any of a variety of system support framework means.

SUMMARY OF THE INVENTION

A reusable low maintenance forming system for forming concrete floors, ceilings and walls with joists thereunder utilizes concrete displacement form pans supported by a temporary framework and floor. A plurality of alignment channels are arranged in parallel series of elongate aligned rows and are adapted to alignably receive and support the flanges of parallel and adjacent form pans. A plurality of joist bottomed wedges are arranged in parallel series of aligned rows and adapted to fit within the alignment channels as to abut and seal against the lower free ends of the form pans afterwhich uncured concrete may be placed over the system.

A principal object and advantage of the present invention is that the new and improved forming system advantageously creates efficient, economical, rapid, attractive, accurate, and high quality concrete floors, roof decks and wall structures.

Another object and advantage of the present invention includes the improved appearance of ceilings and the underside of roof decks constructed with this system.

Another object and advantage of the present invention is that the system is easily removed after the concrete has set without the necessity of chiseling or prying, which is highly destructive to the pan forms.

Another object and advantage of the present invention is that it is usable with any framing means, including various support framework, temporary decking, false framework and flying false framework.

Another object and advantage of the present invention is that it is usable with existing flange forms or form pans and further eliminates the need for internal bracing within the pans.

Another object and advantage of the system is that it easily sets up in inclimate weather which is typical of construction sites.

Another object and advantage of the present invention is that it is usable with floor and ceiling framework typically used in a bay surrounded by four columns together with flying false framework support.

Another object and advantage of the present invention is that the system minimizes the maintenance typically required of the flange portions of the form pans and therefore prolongs the life of the form pans with minimal damage.

Yet another object and advantage of the present invention is that the components are suitably made of pultruded structural fiberglass or reinforced plastic which is corrosion proof, resilient, nonbendable and not affected by the corrosive effects of curing concrete and weather.

BRIEF DESCRIPTION OF THE DRAWINGS

FIG. 3 is a front elevational view partially broken away of prior art forming systems of FIGS. 1 and 2 with uncured concrete placed thereon as to form either a floor or ceiling;

FIG. 5 is a front elevational view partially broken away of the cured concrete with the support framework removed leaving the form pans yet to be removed;

DETAILED SPECIFICATION

Figure 1:
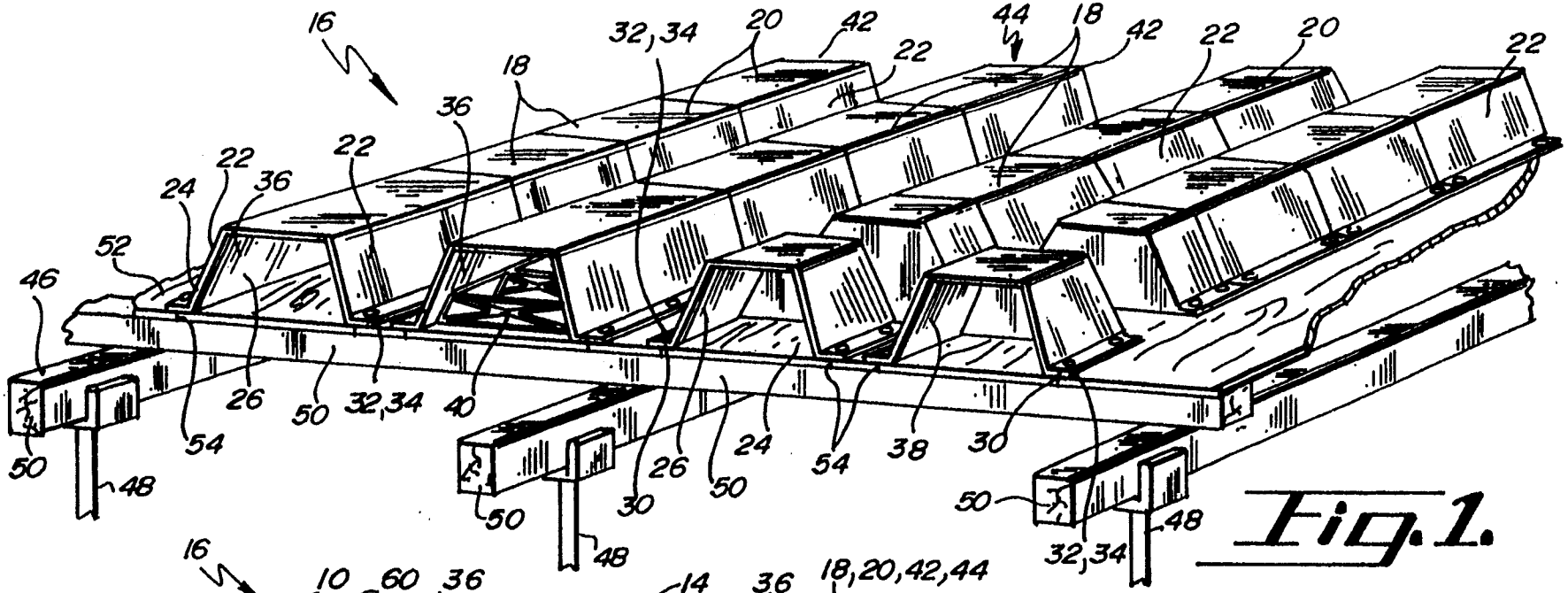
FIG. 1 is a perspective view partially broken away of a prior art forming system ready to receive concrete thereon for forming either a floor or ceiling.
Figure 2:
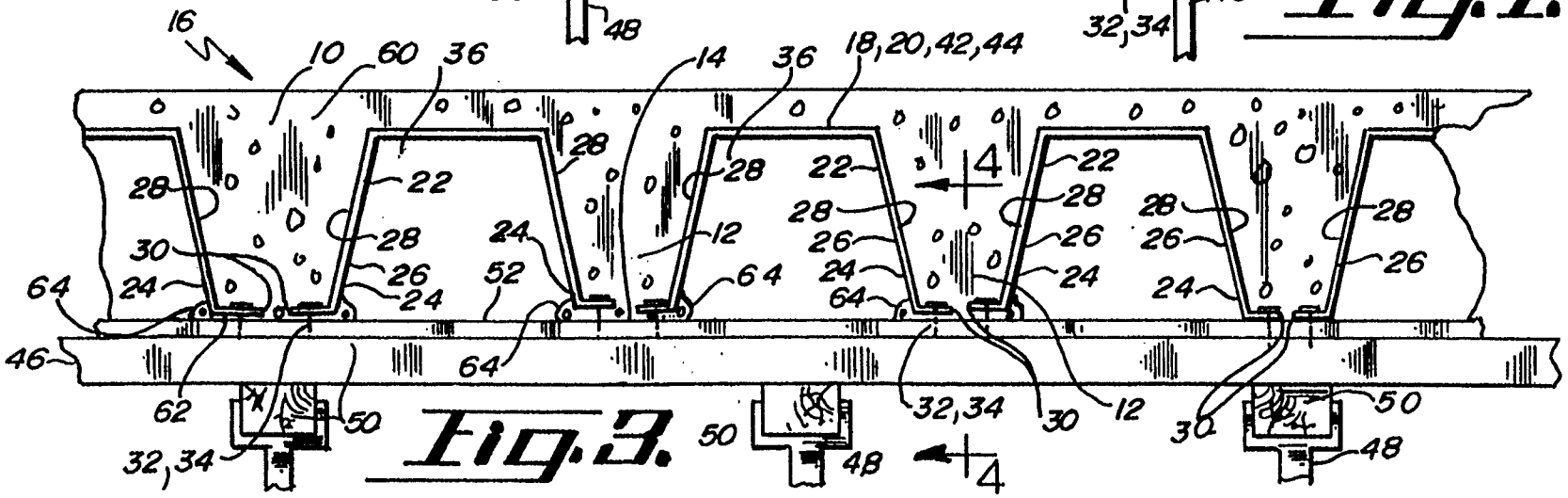
FIG. 2 is a front elevational view partially broken away of the prior art structure of FIG. 1.
Figure 8:
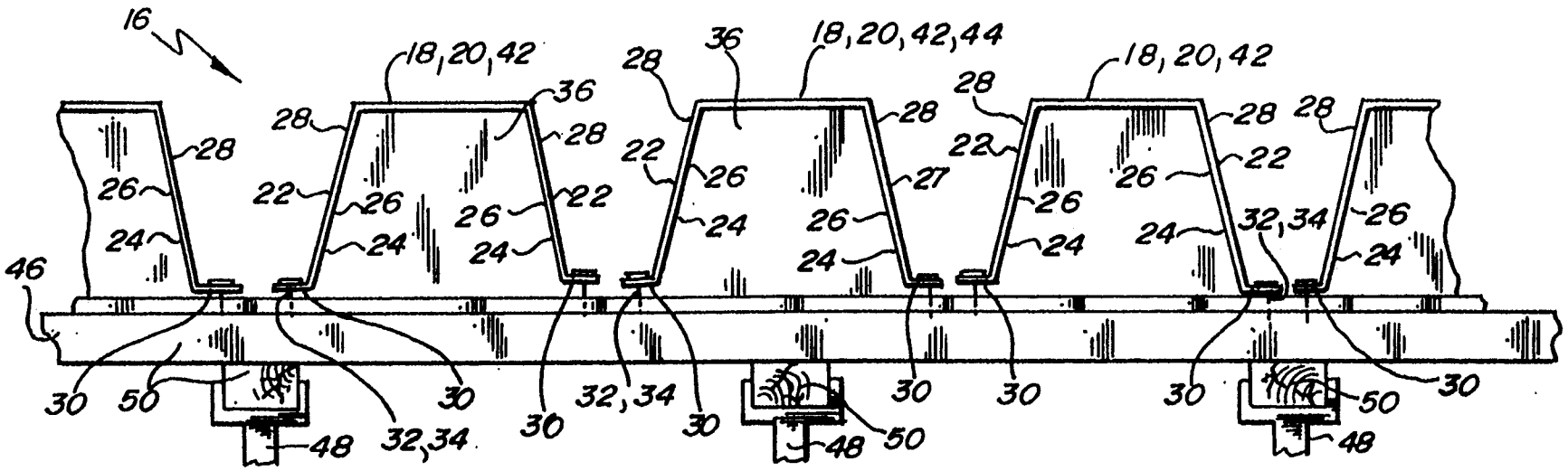
FIG. 8 is a top plan view of an alignment channel broken away.
Figure 9:
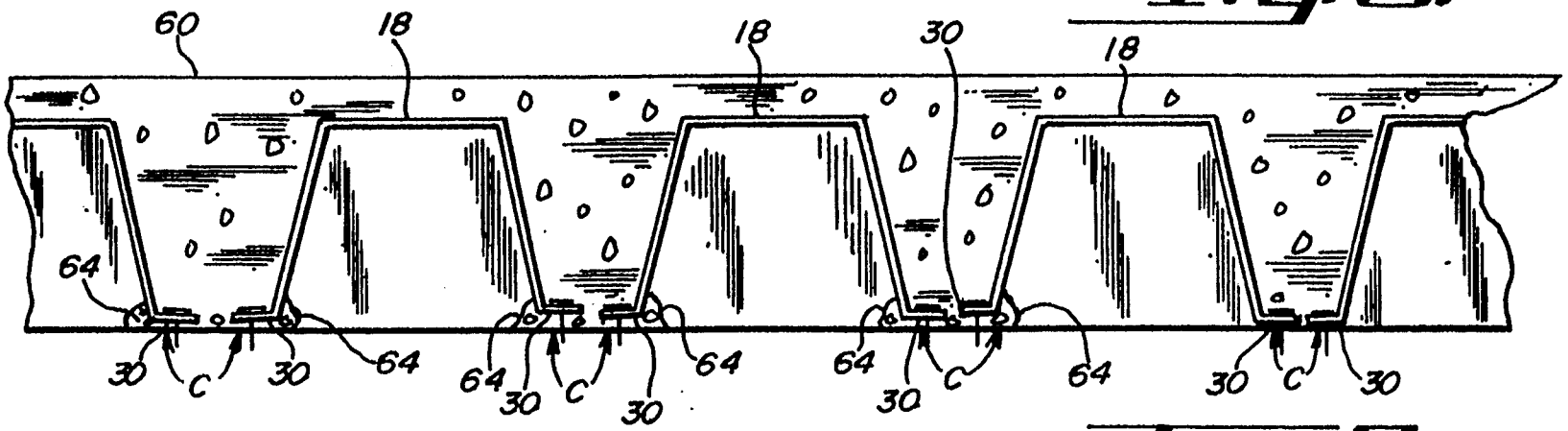
FIG. 9 is a front elevational view partially broken away of the support framework and the aligned channels supporting the aligned displacement form pans.
Figure 9:
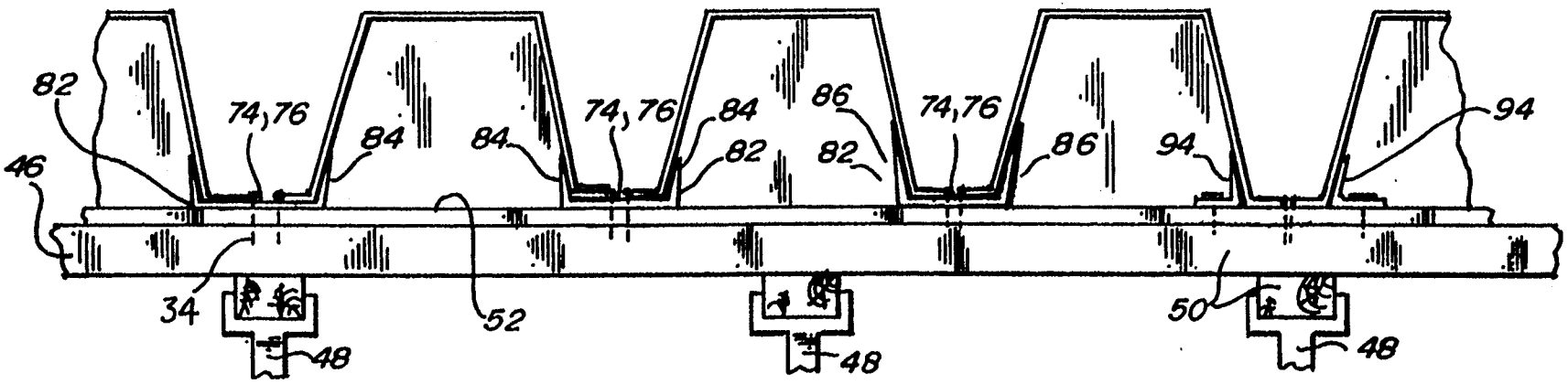

The present invention comprises a new forming system 70 for concrete floors and roof decks 10 typically having parallel ribs, beams or joists 12 thereunder and joist bottoms or bases 14. The new forming system 70 generally includes a support framework 46, alignment channels 74, flange forms 18 and joist bottom wedges 94 or 112.

To appreciate the invention, one must have an understanding of prior art forming systems 16 shown in FIGS. 1 through 6. Such systems 16 typically include flange forms, form pans or displacement forms 18 that are reusable, stackable, interchangeable, and often made of fourteen gauge steel that is commonly 1/16 of an inch thick. The form pans 18 are twelve to twenty inches high and commonly three feet long. However, pans 18 may vary in dimension to accommodate particular individual engineering requirements. The flange forms 18 have a top wall 20 and depending side walls 22 terminating in lower free ends 24. The side walls 22 have an inside 26 and an outside 28. Extending outwardly from the free ends 26 are support flanges 30 that are typically one to one and one half inch in width. The four corners of the forms 18 at flanges 30 commonly have apertures 32 where through nails 34 may be driven into the support framework 46 described below. The forms 18 have open ends 36 which permit overlap of the forms to adjust the length of the particular aligned pan row 42. End form pans or caps 38 are often used to terminate the formwork structure. Often internal reinforcement bracing 40 is utilized within the forms 18 to assure that they do not cave inwardly under the force of the placed concrete 60.

The parallel series 44 of elongate aligned rows 42 of flange forms 18 are supported by a support framework 46 which often may be referred to as a temporary decking or framing falsework. Such framework 46 typically has adjustable support posts 48 and supporting cross beams 50 which further support a false deck or floor 52 commonly made of lumber or plywood to securely receive nails 34. Once the support framework 46 is positioned, chalk lines 54 are snapped and the flange forms 18 are aligned and secured to the plywood floor 52. Thereafter, concrete 60 is placed over the structure as to be illustratively four to six inches thick over the top wall 20 of the forms 18.

Figure 4:
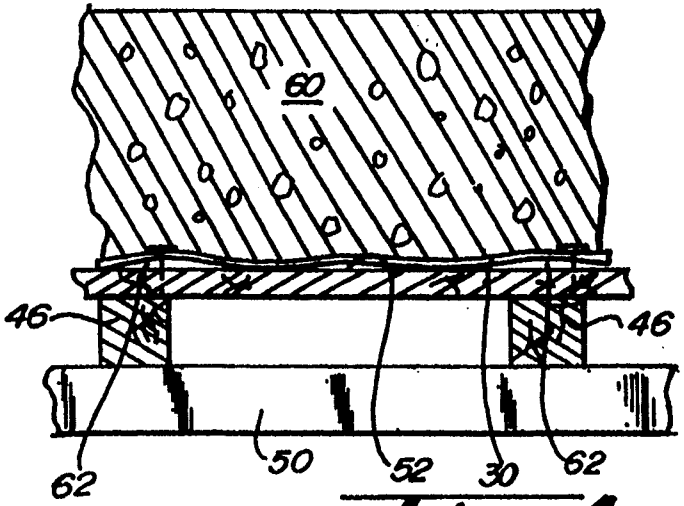
FIG. 4 is a cross sectional view taken along lines 4—4 of FIG. 3.
Figure 6:
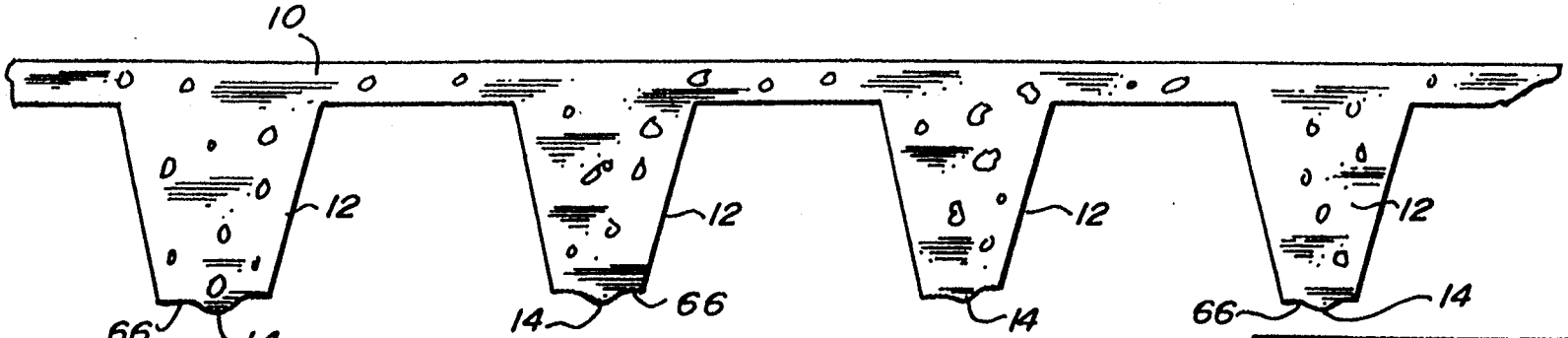
FIG. 6 is a front elevational view partially broken away of a completed floor or roof structure of concrete with the pans of FIG. 5 removed.
Figure 7:
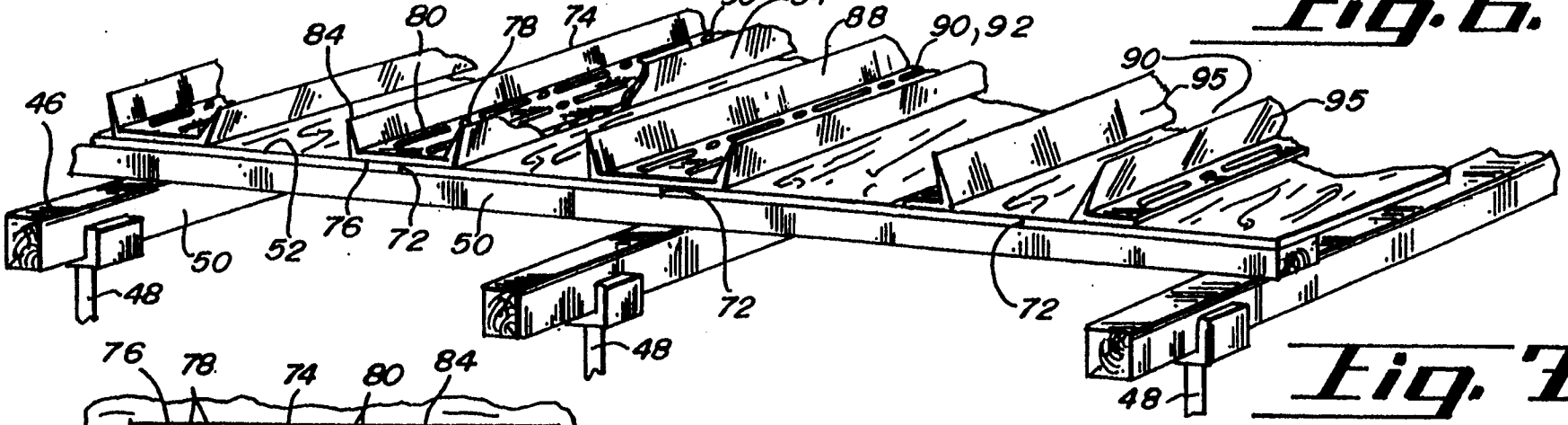
FIG. 7 is a perspective view partially broken away of a support framework supporting parallel series of elongate aligned rows of alignment channels.
Figure 8:
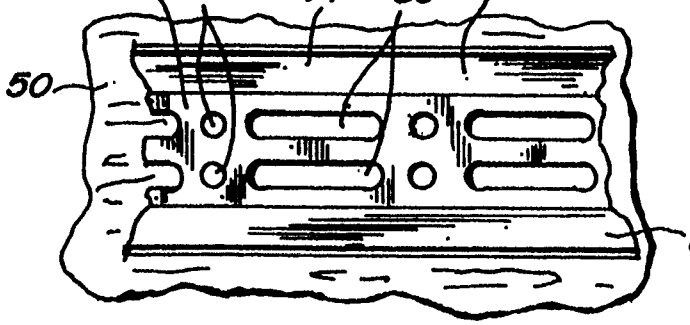

Specifically referring to FIGS. 4 and 5, the placed concrete 60 has a tendency to creep into the space 62 between the false plywood floor 52 and the flanges 30 of the forms 18 thereby forming beads or globs 64 of concrete. After the concrete has cured and the support framework 46 has been removed, it is necessary for the workmen to chisel and pry at arrow C to reach the support flanges 30 of the flange forms 18 and to pull them out of the cured concrete. This effort results in both an uneven joist base 66 as well as damage and required maintenance to the flange forms 18, particularly the support flanges 30.

Referring to FIGS. 7 through 13, the unique forming system 70 of the present invention may be appreciated. Once the support framework 46 is set up, chalk lines 72 are snapped. Thereafter, alignment channels, troughs or boxes 74 are aligned onto the floor 52 with respect to the chalk lines or tape measurements 72 which desirably may be used, such as in inclimate weather. The channels 74 are illustratively six inches wide and $\frac{3}{8}$ inch thick and may be constructed of a variety of material but have been found to work well out of formed metal, reinforced plastic or pultruded structural fiberglass, such as that made by Advance Fiber Products of 120-6th Avenue Southeast, Winnebago, Minn. 56098. However, engineering demands may vary the dimensions and materials.

The alignment channels 74 appropriately have a base 76 with apertures 78 therethrough which permits securement of the alignment channel 74 to the floor 52 suitably by nails 34. Thereafter, the channels 74 alignably receive the flanges 30 of pans 18. Slots 80 are also provided in the alignment channel 74 as they are alignable with the joist bottom wedges 94 as will be appreciated below. The channels 74 have reinforced corners 82 from which outwardly and upwardly extends support shoulders or flanges 84 which appropriately may be one and three eighths inch in height illustratively. Additionally, tall reinforcement shoulders 86 may be provided that are four to six inches in height, illustratively, thereby replacing the necessity of internal reinforcement bracing 40. The alignment channels 74 appropriately have open ends 88 which permit an arrangement of parallel series 92 of aligned rows 90 of channels 74 in an overlapping, abutting or jointable arrangement. Channels 74 may also be substituted by L-shaped brackets 95 as will obviously be appreciated.

Figure 10:
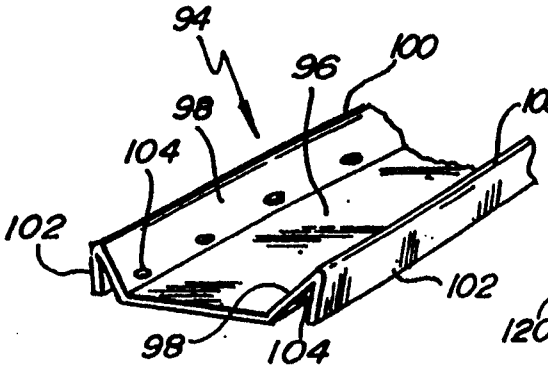
FIG. 10 is a perspective view partially broken away of one form of the joist bottom wedge of the present invention.
Figure 11:
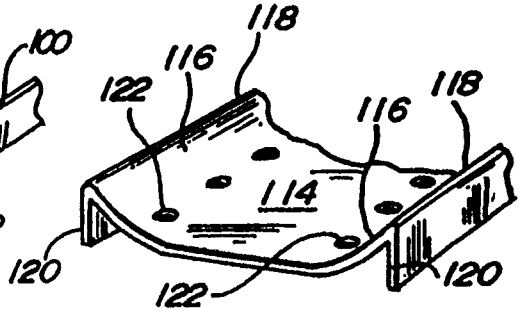
FIG. 11 is a perspective view of yet another embodiment of the joist bottom wedges of the present invention partially broken away.
Figures 12, 13:
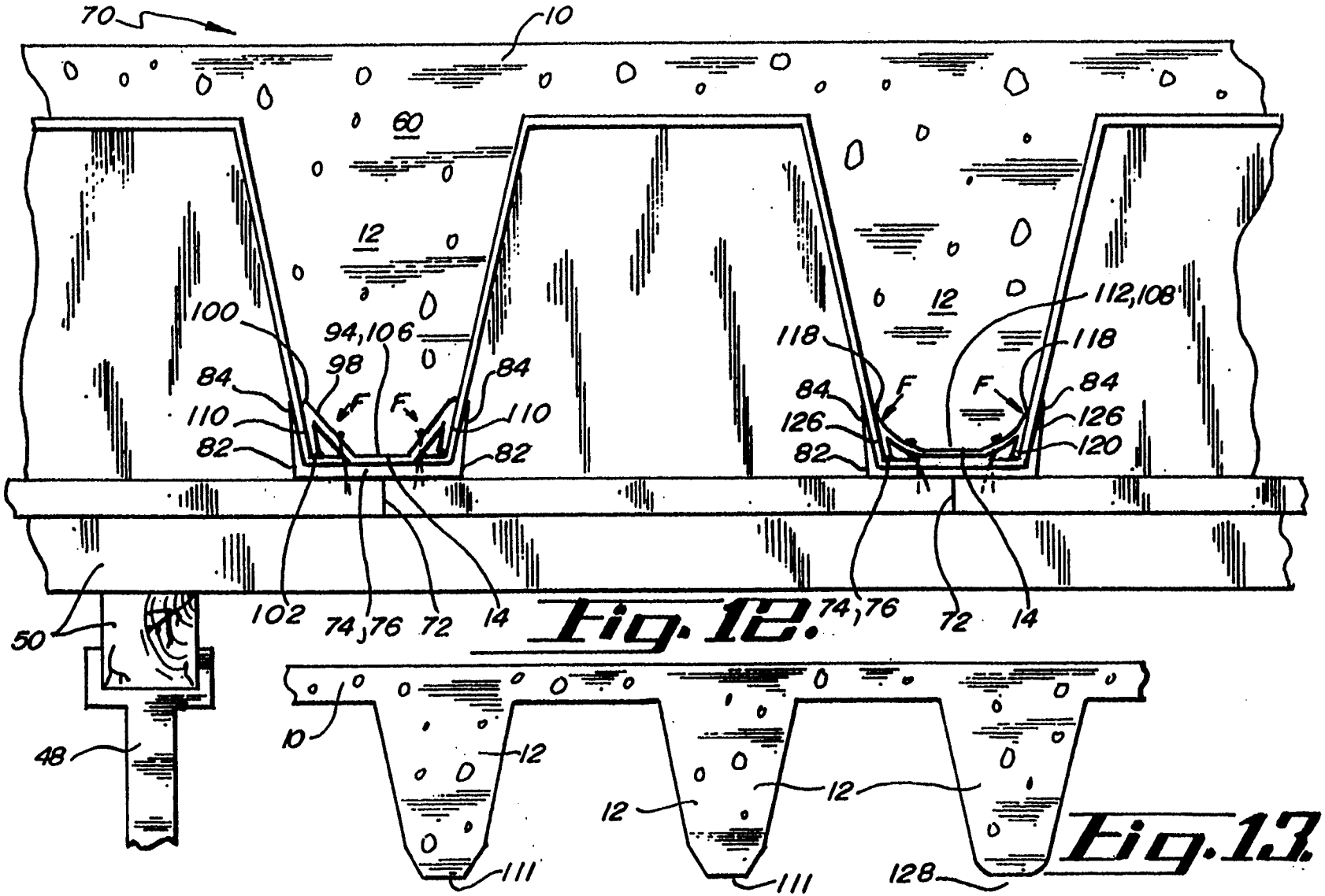
FIG. 12 is a front elevational view of the new forming system of the present invention supporting concrete during its curing process.
FIG. 13 is a front elevational view of a concrete floor or ceiling constructed by the present invention.

Joist bottom wedges 94 are shown in FIGS. 10 through 12 and appropriately are contoured or M-shaped and approximately six inches in width for illustration purposes. The wedges 94 also may be made of the pultruded structural fiberglass for noncorrosion and strength purposes. The wedges 94 have flat, intermediate or central portions 96 with inclined walls 98 terminating in peaks 100 which engage the outside 28 of pan side walls 22. Extending downward from peaks 100 are depending feet 102. Along the inclined walls 98 appropriately are parallel apertures 104 which are alignable with the slots 80 of the alignment channels and will permit the securement of the wedges 94 within the alignment channels 74 suitably by nails.

The joist bottom wedges 94 are intended to be arranged in parallel series 108 of elongate aligned rows 106 in jointable arrangement and adapted to fit within one row 90 of the alignment channels 74 afterwhich they are secured suitably by nails so that the peaks 100 engage the outside 28 of pan side walls 22. As the concrete 60 is placed into the system 70, the concrete force, represented by arrow F, permits the joist bottom wedges 94 to expand outwardly under the weight of the uncured concrete as to further create a tighter seal 110 between the wedge 94 and the form pans 18 adjacent the lower free ends 24.

FIGS. 11 and 12 show an alternate structure of the joist bottom wedge 112 made of the fiberglass material preferably. The wedge 112 has a U-shaped structure with a flat, intermediate or central portion 114. The inclined walls 116 are appropriately constructed with a radius, such as $1\frac{7}{8}$ inch illustratively, terminating at peaks 118. The radius dimension is suitably determined by the required rebar coverages and particular structural design of reinforcement steel in concrete. Extending downward from peaks 118 are depending feet 120. Parallel apertures 122 are along the inclined walls 116 and are suitably alignable with the slots 80 of the alignment channels 74 for securing this embodiment of the wedge 112 to the channels 74 as is appreciated above.

Similarly, as placed concrete 60 is placed into the system 70, the concrete force, shown by arrow F, creates a seal 126 between the peak 118 and feet 120 and the pan side walls 22 adjacent the lower free ends 24.

Referring to FIG. 13, the newly created concrete floor or ceiling has an even or smooth base, 111 or 128 respectively, depending on which wedge 94 or 112 was used by the worker. What is most important, the removal of the support frame structure 46 easily permits the removal of the floor 52, alignment channels 74, form pans 18 and the wedges 94 or 112 simultaneously. By this arrangement, the new forming system 70 readily permits itself to be used with flying support framework requiring further minimal worker's time in setting up and removing the flange forms and further in maintaining the forms.

The newly created concrete structure 10 may additionally be oriented vertically to form a wall structure.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. A reusable low maintenance forming apparatus for forming concrete floors, ceilings and walls having concrete joists thereunder, the apparatus supportable by temporary framework and floor, comprising:

(a) a plurality of displacement form pans each including a top wall, two opposing depending side walls each with a lower free end with an outwardly directed support flange extending from the free end, the pans further each having overlapable open ends for interconnecting the pans in parallel series of elongate aligned rows;

(b) a plurality of alignment channels with jointable open ends for interconnecting the channels in parallel series of elongate aligned rows extending the length of the aligned rows of form pans, the channels adapted to be releaseably fastenable to the temporary floor, each row of channels further being adapted to alignably receive and support the opposing support flanges of the parallel and adjacent form pan rows; and (c) a plurality of contoured, expandable joist bottom wedges jointable for interconnecting the wedges in parallel series of elongate aligned rows extending the length of the aligned rows of form pans, each row of joist bottom wedges adapted to fit within one row of alignment channels as to abut the lower free ends of the opposing form pans within the alignment channels after which uncured concrete placed over the apparatus and the wedges create a seal between opposing form pans under the weight of the concrete to create concrete floors, ceilings and walls with removal of the apparatus after concrete curing, wherein said joist bottom wedges are M-shaped in cross section.

2. The floor and ceiling forming apparatus of claim 1 wherein the joist bottom wedges expand outwardly under the weight of the uncured concrete as to create a seal between the wedge and the lower free end of the form pans.

3. The floor and ceiling forming apparatus of claim 1 wherein the joist bottom wedges are made from a selective group consisting of structural fiberglass, reinforced plastic and metal.

4. The floor and ceiling forming apparatus of claim 1 wherein the joist bottom wedges are releasably fastenable within their respective channels to the temporary floor.

5. The floor and ceiling forming apparatus of claim 1 wherein the alignment channels further comprise upward and outward shoulders for supporting the inside of the lower free ends of the aligned and adjacent form pan side walls of parallel and adjacent form pan rows.

6. The floor and ceiling forming apparatus of claim 1 wherein the alignment channels further comprise upward and outward shoulders for supporting the inside of the depending side walls of the aligned parallel and adjacent form pans.

7. The floor and ceiling forming apparatus of claim 1 wherein the alignment channels are U-shaped in cross section.

8. The floor and ceiling forming apparatus of claim 1 wherein the alignment channels are formed by opposing L-shaped brackets.

9. The floor and ceiling forming apparatus of claim 1 wherein the alignment channels are made from a selective group consisting of structural fiberglass, reinforced plastic and metal.

10. A reusable low maintenance forming apparatus for forming concrete floors, ceilings and walls having concrete joists thereunder, the apparatus supportable by temporary framework and floor, comprising:

(a) a plurality of displacement form pans each including a top wall, two opposing depending side walls each with a lower free end with an outwardly directed support flange extending from the free end, the pans further each having overlapable open ends for interconnecting the pans in parallel series of elongate aligned rows;

(b) a plurality of alignment channels each with opposing upward and outward shoulders with jointable open ends for interconnecting the channels in parallel series of elongate aligned rows extending the length of the aligned rows of form pans, the channels adapted to be releaseably fastenable to the temporary floor, each row of channels further being adapted to alignably receive the opposing support flanges of the parallel and adjacent form pan rows while the shoulders support the inside of the side walls and lower free ends; and (c) a plurality of contoured, expandable joist bottom wedges jointable for interconnecting the wedges in parallel series of elongate aligned rows extending the length of the aligned rows of form pans, each row of joist bottom wedges adapted to fit within one row of alignment channels as to abut the lower free ends of the opposing form pans within the alignment channels after which uncured concrete placed over the apparatus and the wedges create a seal between opposing form pans under the weight of the concrete to create concrete floors, ceilings and walls with removal of the apparatus after concrete curing wherein said joist bottom wedges are U-shaped in cross section.

11. The floor and ceiling forming apparatus of claim 10 wherein the joist bottom wedges are made from a selective group consisting of structural fiberglass, reinforced plastic and metal.

12. The floor and ceiling forming apparatus of claim 10 wherein the joist bottom wedges are releasably fastenable within their respective channels to the temporary floor.

13. The floor and ceiling forming apparatus of claim 10 wherein the alignment channels are made from a selective group consisting of structural fiberglass, reinforced plastic and metal.

14. A reusable low maintenance forming apparatus for forming concrete floors, ceilings and walls having concrete joists thereunder, the apparatus supportable by temporary framework and floor, comprising:

(a) a plurality of displacement form pans each including a top wall, two opposing depending side walls each with a lower free end with an outwardly directed support flange extending from the free end, the pans further each having overlapable open ends for interconnecting the pans in parallel series of elongate aligned rows;

(b) a plurality of U-shaped reinforced plastic alignment channels each with opposing upward and outward shoulders with jointable open ends for interconnecting the channels in parallel series of elongate aligned rows extending the length of the aligned rows of form pans, the channels adapted to be releaseably fastenable to the temporary floor, each row of channels further being adapted to alignably receive the opposing support flanges of the parallel and adjacent form pan rows while the shoulders support the inside of the side walls and lower free ends; and (c) a plurality of contoured, expandable, reinforced plastic joist bottom wedges jointable for interconnecting the wedges in parallel series of elongate aligned rows extending the length of the aligned rows of form pans, each row of joist bottom wedges adapted to fit within one row of alignment channels as to abut the lower free ends of the opposing form pans within the alignment channels after which uncured concrete placed over the apparatus and the wedges cream a seal between opposing form pans under the weight of the concrete as to cover the forms, the joist bottom wedges being expandable outwardly under the weight of the uncured concrete as to cream a seal between the wedge and the lower free end of the form pans to cream concrete floors, ceilings and walls with removal of the apparatus after concrete curing, wherein said joist bottom wedges are M-shaped or U-shaped in cross section.

15. The floor and ceiling forming apparatus of claim 12 wherein the joist bottom wedges are M-shaped in cross section.

16. The floor and ceiling forming apparatus of claim 14 wherein the joist bottom wedges are U-shaped in cross section.

17. The floor and ceiling forming apparatus of claim 14 wherein the joist bottom wedges are releasably fastenable within their respective channels to the temporary floor.

18. The floor and ceiling forming apparatus of claim 14 wherein the alignment channels are formed by opposing L-shaped brackets.

* * * * *